US010085576B1

(12) United States Patent
Juarbe

(10) Patent No.: US 10,085,576 B1
(45) Date of Patent: Oct. 2, 2018

(54) DRINKING STRAW WITH A DISPLAY ARRANGEMENT

(71) Applicant: Isreal Juarbe, Bronx, NY (US)

(72) Inventor: Isreal Juarbe, Bronx, NY (US)

( * ) Notice: Subject to any disclaimer, the term of this patent is extended or adjusted under 35 U.S.C. 154(b) by 0 days.

(21) Appl. No.: 15/477,604

(22) Filed: Apr. 3, 2017

(51) Int. Cl.
*A47G 19/22* (2006.01)
*A47G 21/18* (2006.01)

(52) U.S. Cl.
CPC ..... *A47G 21/182* (2013.01)

(58) Field of Classification Search
CPC ..... A47G 21/186; A47G 21/182; A47G 19/2272; A47G 19/22
USPC ..... 220/710, 705
See application file for complete search history.

(56) References Cited

U.S. PATENT DOCUMENTS

D243,817 S * 3/1977 Cloyd ..... D7/300.2
D784,062 S 4/2017 Juarbe
2013/0032606 A1* 2/2013 Lafever ..... A47G 19/2222 220/710

OTHER PUBLICATIONS

List of references in U.S. Appl. No. 29/545,868 on Oct. 14, 2016.

* cited by examiner

*Primary Examiner* — King M Chu
(74) *Attorney, Agent, or Firm* — Lawrence G. Fridman, Esq.; Feigin & Fridman, LLC

(57) ABSTRACT

A drinking straw has a display arrangement mounted thereon or attached thereto, where the display arrangement bears a graphic representation, such as an advertisement or an amusing graphic representation. When the drinking straw is disposed within a cup, the display arrangement is adapted to engage an exterior surface of the cup, so that the straw remains upright in the cup adjacent the side thereof.

17 Claims, 7 Drawing Sheets

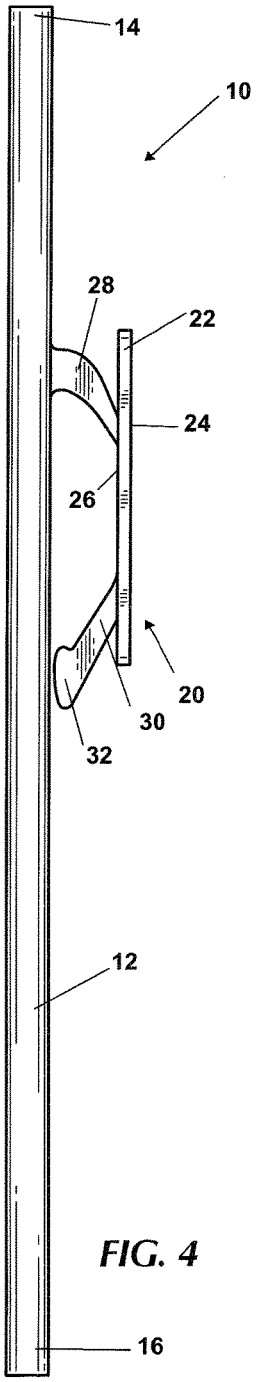
FIG. 4
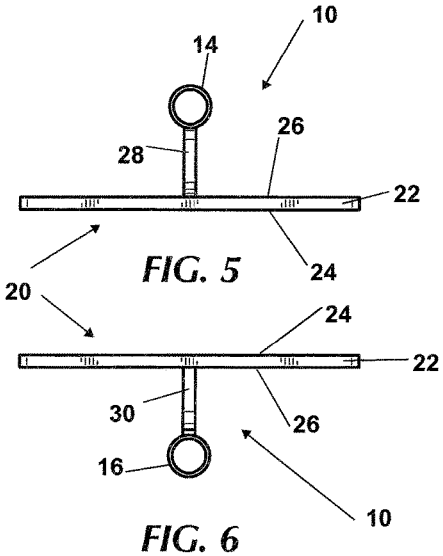
FIG. 5
FIG. 6
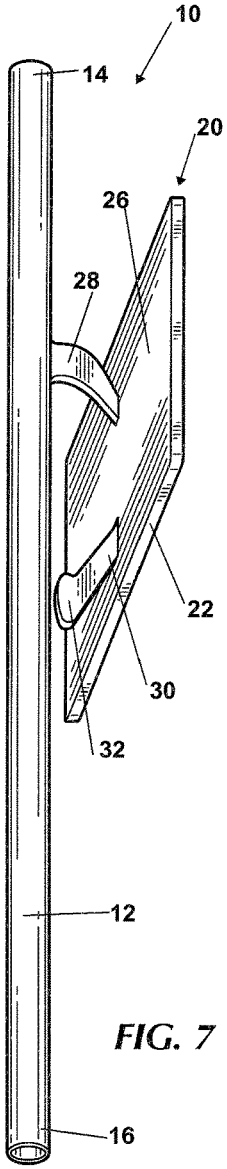
FIG. 7

DRINKING STRAW WITH A DISPLAY ARRANGEMENT

FIELD AND BACKGROUND OF THE DISCLOSED TECHNOLOGY

The disclosed technology relates generally to drinking straws, and, more specifically, to a drinking straw including a display arrangement for displaying a language or graphic representation thereon, the drinking straw being connectable to the side of a drinking cup.

U.S. Pat. No. 5,427,315 to Lipson is directed to a drinking straw which includes a planar insert for display of amusement or advertising indicia thereon. The straw includes a drinking tube having linearly extending first and second ends, and a loop disposed therebetween, A planar insert is attached to the loop by means of a first cutout portion through which an attachment portion of the loop passes.

U.S. Pat. No. 4,724,518 to Martina et al is directed to a straw for sucking beverages which can be utilized to convey advertising information and messages. The straw includes a panel having two opposing flat major faces, a plurality of channels extending between the major faces and having open ends at opposite edges of the panel, and at least one liquid suction region and liquid pickup region which are formed at the edges and interconnected by at least two of the channels.

However, none of the straw arrangements discussed above are provided with a display arrangement capable of displaying a graphic or any other representation visible to the consumer or other individuals in his or her vicinity. Thus, it has been long felt and unsolved need to provide drinking straws with a display arrangement capable of displaying language and/or graphic information, that can be attached to the side of a cup, while a user is utilizing the straw to drink.

SUMMARY OF THE DISCLOSED TECHNOLOGY

The disclosed technology relates generally to drinking straws and, more specifically, to drinking straws that are attachable to the side of a cup and have a language and graphic representation visible thereon.

According to an embodiment of the teachings herein, there is provided a drinking straw usable for drinking a beverage from a cup, the cup having an exterior surface and an interior surface surrounding a hollow, the drinking straw including:

a cylindrical straw having a first end and a second end; and a display arrangement, including:

- a display element having a first broad surface having a graphic representation visible thereon and a second broad surface;
- a straw-attachment element attached to the second broad surface of the display element; and
- a cup-engaging element attached to the second broad surface of the display element in alignment with the straw-attachment element wherein the display arrangement is mounted onto the cylindrical straw, via the straw-attachment element, such that the second broad surface of the display arrangement faces the cylindrical straw and the first end of the cylindrical straw is accessible to a user for drinking therefrom, and wherein, when the drinking straw is disposed in the cup, the cylindrical straw is adapted to be placed within a hollow of the cup adjacent the interior surface of the cup and the display arrangement is adapted to engage the exterior surface of the cup such that the graphic representation is disposed externally to the exterior surface and the cup engaging element engages the exterior surface.

In some embodiments, the straw-attachment element includes an arm having one end attached to the second broad surface of the display element and another end mounted onto the cylindrical straw at a predetermined height thereon. In some embodiments, the arm has a predefined preload urging the display element toward the cylindrical straw.

In some embodiments, the straw-attachment element includes a cylindrical straw-engaging portion having an inner circumference approximately equal to an outer circumference of the cylindrical straw and adapted to be disposed about the cylindrical straw, and a connector portion connecting the straw-engaging portion to the second broad surface.

In some embodiments, the cylindrical straw-engaging portion is adapted to be slidably and removably disposed about the cylindrical straw, such that the display arrangement is slidably and removably mounted onto the cylindrical straw. In some such embodiments, a height of the display arrangement on the cylindrical straw is adjustable to a height of the cup.

In some embodiments, the display element includes a housing portion having a hollow slot formed therein and including an interior portion and an exterior portion defining at least one transparent window and a graphic-bearing portion having the graphic representation disposed thereon and adapted to be inserted into the hollow slot such that the graphic representation is visible through the at least one transparent window.

In some embodiments, the graphic representation is adhesively applied onto the first broad surface. In some embodiments, the graphic representation is printed onto, or otherwise forms an integral part of, the first broad surface.

In some embodiments, the display element includes an electronic display element adapted to electronically display the graphic representation. In some such embodiments, the display arrangement further includes a power source powering the electronic display element. In some such embodiments, the display arrangement further includes a processor, adapted to control operation of the electronic display element and of the graphic representation displayed thereon.

In some embodiments, the cup-engaging element includes a protrusion protruding out of the second broad surface and terminating in a convex shape.

In some embodiments, the cup-engaging element includes a protrusion protruding out of the second broad surface and terminating in a curved concave surface, the concave surface adapted to engage the exterior surface of the cup along a contour thereof. In some such embodiments, the protrusion is flexible, such that a curvature of the curved concave surface adapts to a curvature of the external surface of the cup.

In some embodiments, the cylindrical straw is disposed along a longitudinal axis and does not include any bends.

According to another embodiment of the teachings herein, there is provided a drinking straw usable for drinking a beverage from a cup, the cup having an exterior surface and an interior surface surrounding a hollow, the drinking straw including:

a cylindrical straw having a first end and a second end; and a display arrangement, including:

a display element having a first broad surface having a graphic representation visible thereon and a second broad surface;

an arm having one end attached to the second broad surface of the display element and another end mounted onto the cylindrical straw at a predetermined height thereon, the arm defining a mechanical preload urging the display element toward the cylindrical straw; and a convex cup-engaging element protruding out of the second broad surface of the display element in alignment with the arm, wherein the first end of the cylindrical straw is accessible to a user for drinking therefrom, and wherein, when the drinking straw is disposed in the cup, the cylindrical straw is adapted to be placed within a hollow of the cup adjacent the interior surface of the cup and the display arrangement is adapted to engage the exterior surface of the cup such that the graphic representation is disposed externally to the exterior surface and the cup engaging element engages the exterior surface.

According to yet another embodiment of the teachings herein, there is provided a drinking straw usable for drinking a beverage from a cup, the cup having an exterior surface and an interior surface surrounding a hollow, the drinking straw including:

an elongate straw having a first end and a second end; and a display arrangement, including:

a display element having a first broad surface having a graphic representation visible thereon and a second broad surface;

a straw-attachment element including a straw-engaging portion and a connector portion connecting the straw-engaging portion to the second broad surface; and a cup-engaging element comprising a protrusion protruding out of the second broad surface of the display element and terminating in a curved concave surface, wherein the elongate straw engaging element of the display arrangement is slidably and removably mounted about the elongate straw such that the second broad surface of the display element faces the elongate straw and the first end of the elongate straw is accessible to a user for drinking therefrom, and wherein, when the drinking straw is disposed in the cup, the elongate straw is adapted to be placed within the hollow of the cup adjacent the interior surface of the cup and the display arrangement is adapted to engage the exterior surface of the cup such that the graphic representation is disposed externally to the exterior surface and the cup engaging element engages the exterior surface.

In some embodiments, the display element includes a housing portion having a hollow slot formed therein and including an interior portion and an exterior portion defining at least one transparent window, and a graphic-bearing portion having the graphic representation disposed thereon and adapted to be inserted into the hollow slot such that the graphic representation is visible through the at least one transparent window.

In some embodiments, the elongate straw comprises a cylindrical straw and the straw-engaging portion is generally cylindrical and has an inner circumference approximately equal to an outer circumference of the cylindrical straw.

BRIEF DESCRIPTION OF THE DRAWINGS

FIG. 4 is a side elevational view of the drinking straw of the invention.

FIG. 5 is a top plan view of the drinking straw of the invention.

FIG. 6 is a bottom plan view of the drinking straw of the invention.

FIG. 7 is a rear perspective view illustration of the drinking straw of FIG. 1.

DETAILED DESCRIPTION OF EMBODIMENTS OF THE DISCLOSED TECHNOLOGY

Figure 1:
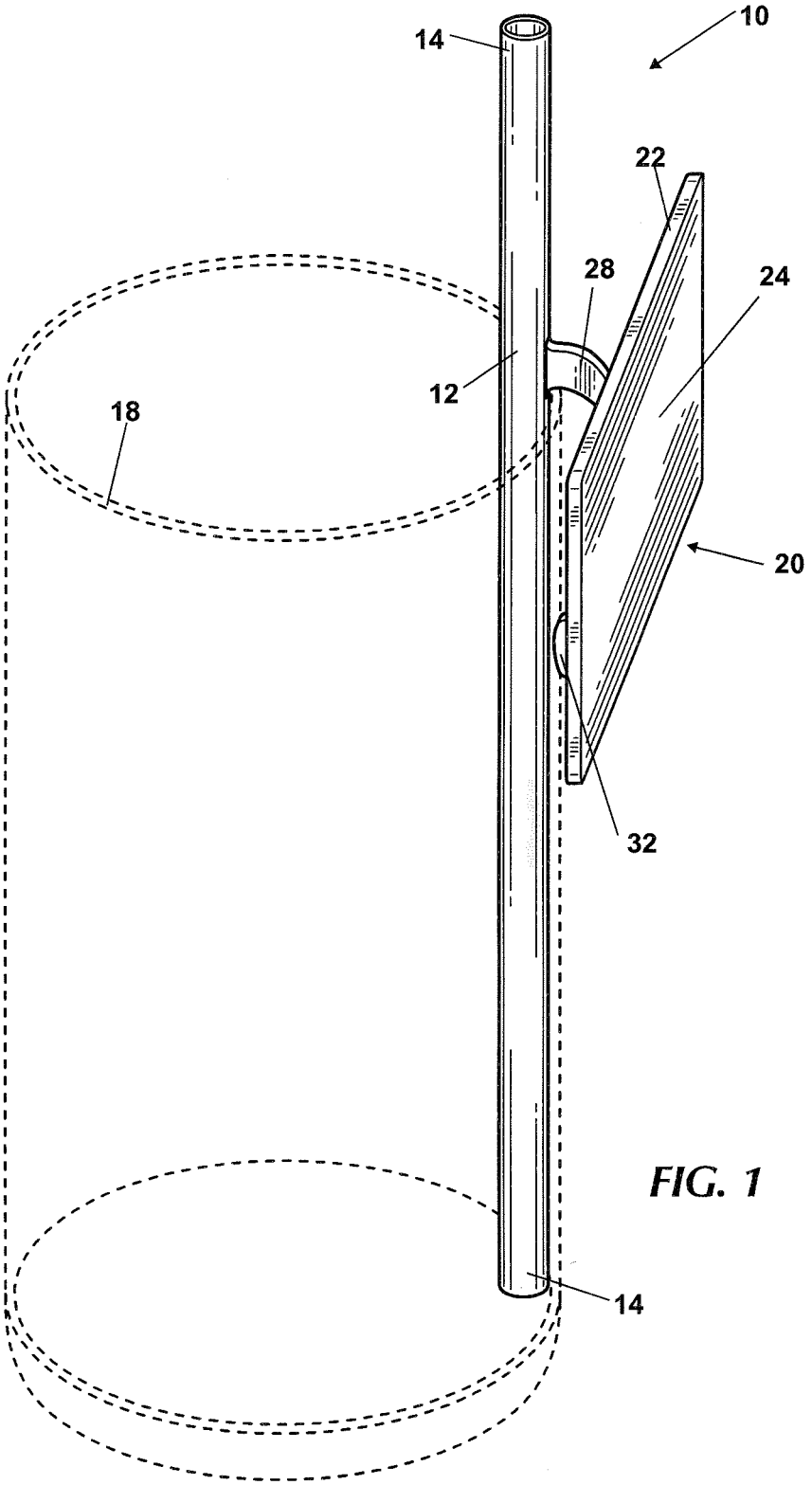
FIG. 1 is a perspective view showing a drinking straw having a display arrangement according to one embodiment of the disclosed technology, wherein the drinking straw is disposed within a drinking cup.
Figure 2:
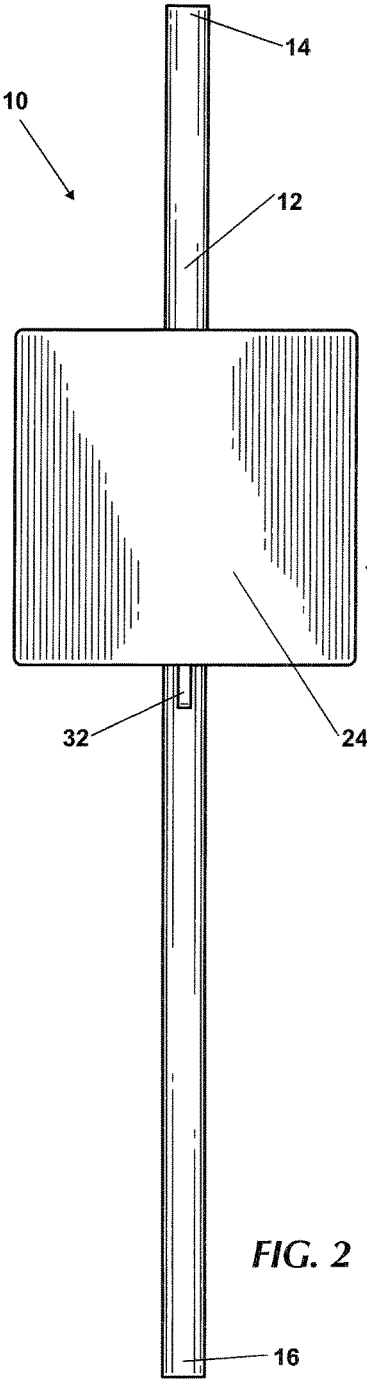
FIG. 2 is a front elevational view of the drinking straw of FIG. 1.

In an embodiment of the disclosed technology, a drinking straw has a display arrangement mounted thereon or attached thereto. The display arrangement bears graphic or language representation, such as an advertisement or any suitable graphic. When the drinking straw is disposed within a cup, the display arrangement is adapted to engage an exterior surface of the cup, so that the straw remains upright in the cup adjacent the side thereof.

According to an aspect of some embodiments of the teachings herein, there is provided a drinking straw usable for drinking beverages from a cup, the cup having an exterior surface and an interior surface surrounding a hollow, the drinking straw including a substantially cylindrical straw having a first end and a second end, and a display arrangement, including a display element having a first broad surface having a language and/or graphic representation visible thereon and a second broad surface. A straw-attachment element is attached to the second broad surface of the display element, and a cup-engaging element attached to the second broad surface of the display element in alignment with the straw-attachment element. In use the display arrangement is mounted onto the cylindrical straw, via the straw-attachment element, such that the second broad surface of the display arrangement faces the cylindrical straw and the first end of the cylindrical straw is accessible to a user for drinking therefrom. The drinking straw is disposed in the cup in such a manner that the cylindrical straw is adapted to be placed within a hollow of the cup adjacent the interior surface of the cup and the display arrangement is adapted to engage the exterior surface of the cup such that the graphic representation is disposed externally to the exterior surface and the cup engaging element engages the exterior surface.

Embodiments of the disclosed technology will become clearer in view of the following description of the drawings.

Reference is now made to FIGS. 1 to 7, which illustrate one embodiment of the teachings herein, in which a display arrangement is fixedly attached to a drinking straw.

A drinking straw 10 according to one embodiment of the invention includes a substantially cylindrical straw 12 having a first end 14 suitable for positioning in the mouth of the user, and a second end 16 adapted to be placed within a cup 18 containing a liquid or drink to be consumed by the user, such that the user draws the liquid from first end 14 into the cylindrical straw 12. Although the straw having the cylindrical configuration and circular cross-section has been illustrated, it should be noted that any conventional cross-section of the straw is within the scope of the invention. In the illustrated embodiment, the straw 12 is arranged in a straight line extending along a longitudinal axis thereof. However, straws of any conventional configuration, for example including twists, loops, or bends are within the scope of the invention.

Mounted onto straw 12 at a predetermined height thereon is a display arrangement 20. The display arrangement 20 includes a display element 22 having a first broad surface 24 facing away from the straw, and a second broad surface 26 facing toward the straw. The first broad surface 24 is adapted to display a graphic or any other representation visible to the consumer or other individuals in his or her vicinity. Although the display arrangement is shown to be fixedly positioned at a predetermined height on the straw, any position of the display arrangement on the straw is contemplated.

As seen clearly in at least FIGS. 4-7, extending from second broad surface 26 is a straw-attachment structure, attaching the display element 22 to the straw 12. In the illustrated embodiment, the straw attachment structure includes an upper arm 28 having one end fixedly attached to the second broad surface 26 and another end fixedly attached to an exterior surface of the straw 12. In some embodiments, arm 28 has a predefined preload or spring type qualities urging the display element 22 towards the straw 12.

Aligned with the upper arm 28 and extending outwardly from the lower portion of second broad surface 26, is a lower arm or cup-engaging member 30. In the embodiment of FIGS. 1-7, the cup-engaging member 30 is a protrusion extending outwardly from the lower portion of the second broad surface 26, and terminating in a convex shape, here shown as an ellipse 32. As illustrated in at least FIGS. 4 and 7, the inner ends of the upper arm 28 and the lower arm 30 connected to the second surface 26 are separated from each other by a substantial space. In one embodiment of the invention, interior surfaces of the arms facing the straw are parts of the same imaginary curve extending through the display element 22.

In use, as best illustrated in FIG. 1, when the drinking straw 10 is disposed within the cup 18, the straw 12 extends longitudinally adjacent an inner surface of the cup, while the display arrangement 20 is disposed outside of the cup. In some embodiments, see for example FIG. 1, the upper arm 28 extends over the rim of the cup, such that the second broad surface 26 is positioned adjacent an exterior surface of the cup, and the lower arm or cup-engaging element 30 engages or positioned at the very close vicinity to the exterior surface of the cup. In some embodiments, the height at which the display arrangement is disposed on the straw 12 is determined in accordance to the height of a typical cup in which the drinking straw 10 will be used, so that the upper arm 28 extends over the rim of the cup while the second end 16 of the straw 12 is adjacent the bottom of the cup and the cup engaging element 30 is aligned with the exterior surface of the cup.

In some embodiments, in view of the spring type qualities of the upper arm 28, the lower arm or cup engaging element 30 is urged inwardly toward the exterior surface of the cup 18. In this manner, the straw arrangement 10 is removably arranged on the wall of cup 18 in a predetermined position. In some embodiments, the convex shape of the element 32 engages the exterior surface of the cup at a single point.

The graphic or any other representation provided on the first broad surface 24, and visible to the consumer and other individuals in his or her vicinity, may include an advertisement, a picture, any graphic representation such as a logo, cartoon character, or mascot, an informational graphic representation such as nutritional information of the beverage in the cup, and the like. In some embodiments, the graphic representation comprises a lenticular graphic representation.

The graphic representation may be provided on the first broad surface 24 by any suitable means. In some embodiments, a graphic-representation bearing portion, such as a paper or nylon sheet is adhesively applied onto the first broad surface 24. In some embodiments, the graphic representation is printed or etched directly onto the first broad surface 24.

Figure 3:
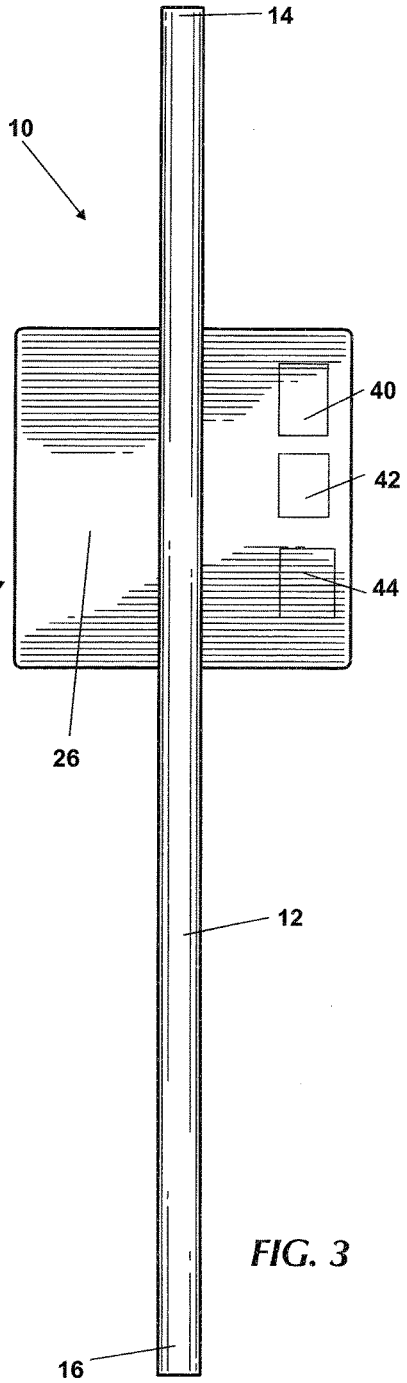
FIG. 3 is a rear elevational view of the drinking straw of the invention.
Figure 3A:
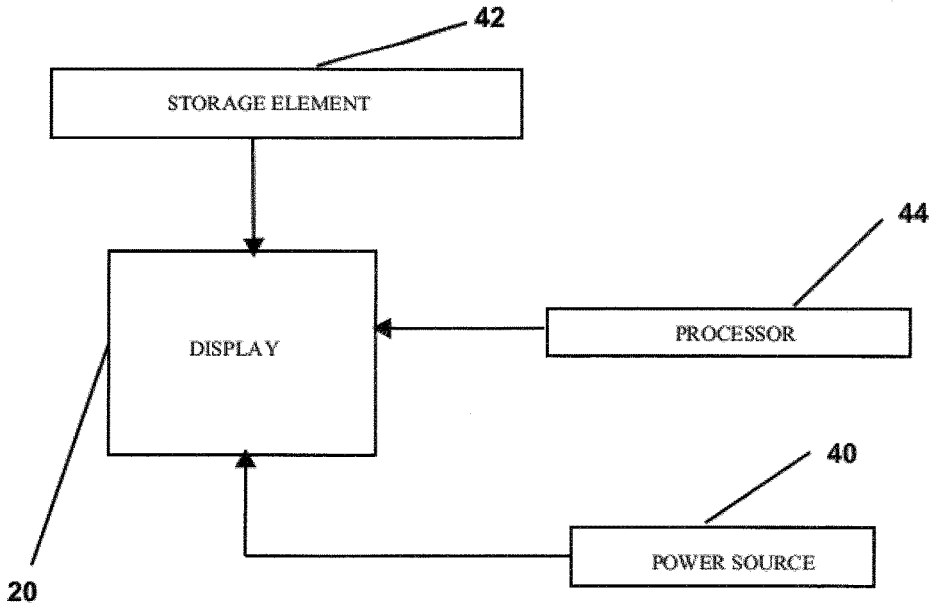
FIG. 3A is a schematic diagram representing a display arrangement.

In some embodiments, the display element 22 comprises an electronic display element. The electronic display element may comprise an LCD screen or a collection of neon or LED lights which together form a display, as often found on storefronts. In some such embodiments, as schematically illustrated in FIG. 3 and FIG. 3A, the display arrangement 20 further includes a power source 40 adapted for powering the display element. In some embodiments, the electronic display element is functionally associated with a storage element 42, storing graphic representations and/or images to be displayed on the electronic display element, and/or with a processor 44 controlling operation of the electronic display element and the specific graphic representations to be displayed thereon.

Reference is now made to FIGS. 8 to 16, which illustrate another embodiment of the invention, in which a display arrangement adapted to adjustably accommodate various content including graphics and other materials mounted on the drinking straw.

Figure 8:
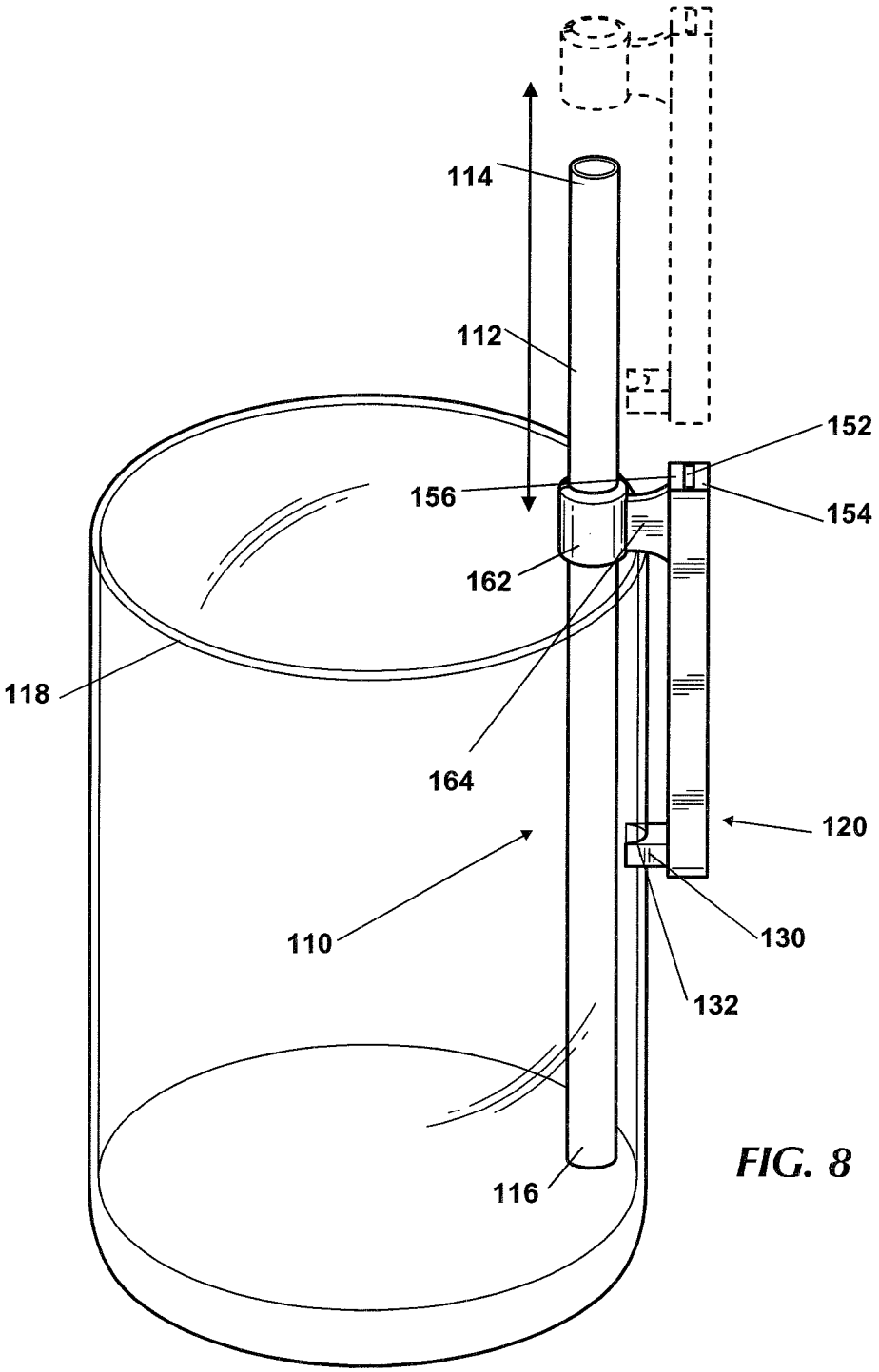
FIG. 8 is a perspective view of a drinking straw and display arrangement according to another embodiment of the disclosed technology, wherein the drinking straw is disposed within a drinking cup.
Figure 9:
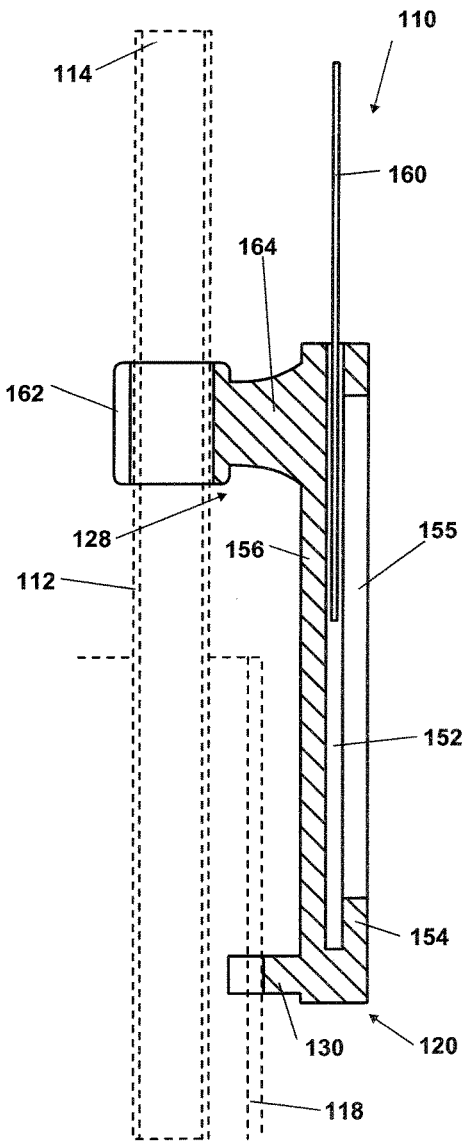
FIG. 9 is a cross sectional view of the drinking straw and display arrangement of FIG. 8.
Figure 10:
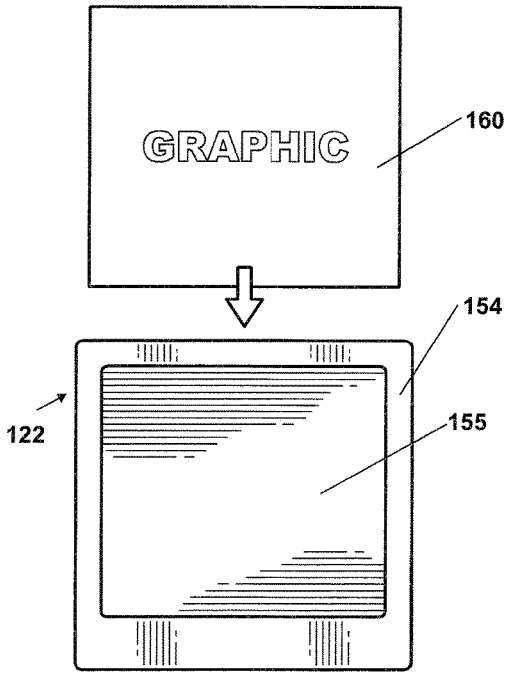
FIGS. 10 and 11 are front plan view illustrations of the display arrangement of FIG. 8 with a graphic-bearing portion disposed outside the display arrangement and within the display arrangement, respectively.
Figure 11:
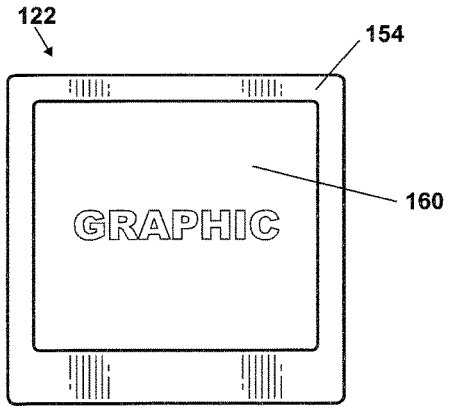
Figure 12:
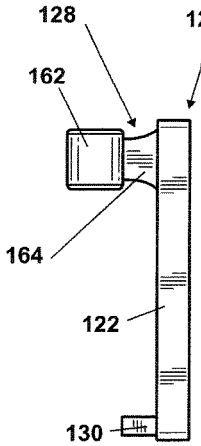
FIG. 12 is a side elevational view of the display arrangement illustrated in FIG. 8.
Figure 13:
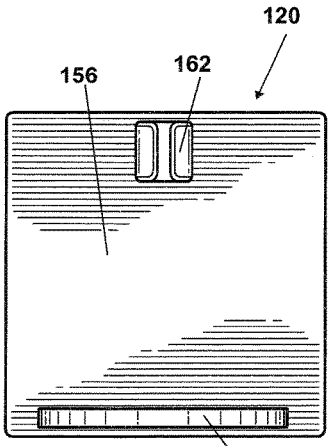
FIG. 13 is a rear elavational view of the display arrangement.
Figure 14:
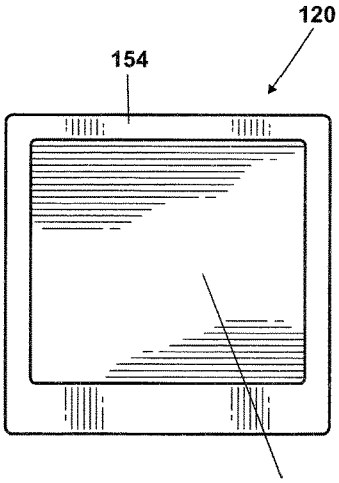
FIG. 14 is a front elavational view of the display arrangement.

As seen in FIGS. 8 and 9, a drinking straw 110 according to the illustrated embodiment includes a substantially cylindrical straw 112 having a first end 114 suitable to be positioned in the mouth of the user, and a second end 116 adapted to be placed within the liquid in a cup 118, such that the user draws the liquid from first end 114 into the cylindrical straw 112. As previously discussed, the straw 112 has a straight-line configuration extending along a longitudinal axis thereof. However, the straws of any conventional configuration including twists, loops, or bends are within the scope of the invention.

A display arrangement 120, which is adapted to be mounted onto straw 112 is illustrated in FIGS. 8 to 16. The display arrangement 120 includes a display element 122, a straw-attachment unit 128, and a cup-engagement element 130.

Figure 15:
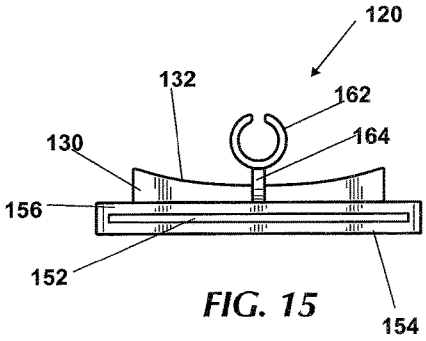
FIG. 15 is a top plan view of the display arrangement.
Figure 16:
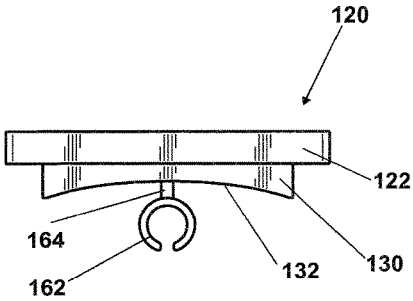
FIG. 16 is a bottom plan view of the display arrangement.

As seen clearly in FIGS. 8, 9, and 15, the display element 122 includes a housing portion 150 having a hollow interior cavity 152 formed therein. The housing portion 150 includes an exterior portion 154 defining at least one transparent window 155, and an interior portion 156 adapted to face straw 112.

A content-bearing unit 160 is formed with an external region having a content representation disposed thereon and an internal region. The unit 160 is adapted to be inserted into hollow cavity 152 such that the external region displaying the content representation is visible through transparent window 155 (see FIGS. 9, 10, and 110), whereas the internal region faces the interior of the cavity 152. In this manner, the graphic or any other representation provided on the external region of the content-bearing unit 160 is visible to the consumer and other individuals in his or her vicinity.

The content representation provided on content-bearing unit 160 may be any suitable graphic or language representation, and may include an advertisement, a picture, an amusing graphic representation such as a logo, cartoon character, or mascot, an informational graphic representation such as nutritional information of the beverage in the cup, and the like. In some embodiments, the content representation is comprised of a lenticular graphic representation.

Extending from interior portion 156, at an upper portion thereof, is a straw-attachment element 128, adapted for adjustably and removably mounting display element 122 onto straw 112. The straw attachment element 128 includes a straw engaging portion 162, which is in the form of generally cylindrical opening but may form an incomplete cylindrical opening, as seen clearly in FIG. 13. The straw engaging portion 162 has an inner circumference which is substantially equal to, or slightly larger than, an outer circumference of straw 112, such that straw engaging portion 162 may be slidably mounted onto straw 112, as seen clearly in FIG. 8. A connector portion 164 connects straw engaging portion 162 to interior portion 156.

Aligned with straw engaging portion 162 and/or with connector portion 164, at a lower area of interior portion 156, is cup-engaging element 130. In the embodiment of FIGS. 8 to 16, the cup-engaging element 130 includes a protrusion extending out of interior portion 156, and formed with a curved concave surface 132 adapted to engage an exterior cylindrical surface of the cup 118.

As illustrated in FIG. 8, when the drinking straw 110 is disposed within cup 118, the straw 112 extends longitudinally adjacent an inner surface of the cup, while the display arrangement 120 is disposed outside of the cup. In some embodiments, such as the illustrated embodiment, straw engaging element 128, and specifically connector portion 164, extend over the rim of the cup, such that the interior portion 156 is disposed adjacent an exterior surface of the cup, and the cup-engaging element 130 engages the exterior surface of the cup.

In this embodiment, the height at which the display arrangement is disposed on the straw 112 is adjustable in accordance with the height of the specific cup, so that connector portion 164 extends over the rim of the cup while the second end 116 of the straw 112 is adjacent to the bottom of the cup and the cup engaging element 130 is aligned with the exterior surface of the cup. In this embodiment, the display arrangement 120 is removable from straw 112, as illustrated by dashed lines in FIG. 8. In this manner, the same display arrangement can be used with a variety of straws and vis versa.

In some embodiments, the cup-engaging element 130 is pliable, flexible, or compressible, such that the concave surface 132 is able to adapt to curvatures of the external surfaces of various cups.

The graphic representation may be provided on the first broad surface 24 by any suitable means. In some embodiments, a graphic-representation bearing portion, such as a paper or nylon sheet is adhesively applied onto the first broad surface 24. In some embodiments, the graphic representation is printed or etched directly onto the first broad surface 24.

In the alternate embodiment, the content-bearing unit 160 can be in the form of a cartridge, which comprises an electronic display element insertable into the cavity 152. The electronic display element may comprise an LCD screen or a collection of neon or LED lights which together form a display. In some embodiments, the content-bearing unit 160 is associated with a power source adapted for powering the display element. In some embodiments, the electronic display element is functionally associated with a storage element provided for storing graphic representations and/or images to be displayed on the electronic display element, and/or with a processor controlling operation of the electronic display element and the specific graphic representations to be displayed thereon.

It has been discussed above that the present invention provides a drinking straws with a display arrangement capable of displaying language and/or any graphic information visible to a user or other individuals in his or her vicinity, that can be attached to the side of a cup and, while the user is drinking from the straw.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A drinking straw usable for drinking a beverage from a cup, the cup having an exterior surface and an interior surface surrounding a hollow, the drinking straw comprising:

a straw having a first end and a second end; and a display arrangement, comprising:

a display element having a first broad surface capable of displaying a language or graphic representation visible thereon and a second broad surface; said display element further comprises a housing portion having a hollow slot formed therein and including an interior portion and an exterior portion defining at least one transparent window; and a graphic-bearing portion having said graphic representation disposed thereon and adapted to be inserted into said hollow slot;

a straw-attachment element attached to said second broad surface of said display element; and a cup-engaging element connected to said second broad surface of said display element in alignment with said straw-attachment element, wherein said display arrangement is mounted onto said straw, via said straw-attachment element, such that said second broad surface of said display element faces said straw and said first end of said straw is accessible to a user for drinking therefrom, and wherein, when said drinking straw is disposed in the cup, said straw is adapted to be placed within the hollow of the cup adjacent the interior surface of the cup and said display arrangement is adapted to engage the exterior surface of the cup such that said language or graphic representation is disposed externally to the exterior surface to be visible through said at least one transparent window and said cup-engaging element engages the exterior surface.

2. The drinking straw of claim 1, wherein said straw-attachment element comprises an arm having one end attached to said second broad surface of said display element and another end mounted onto said straw.

3. The drinking straw of claim 2, wherein said straw is formed having substantially cylindrical configuration, said arm is formed having spring type qualities urging said display element toward said cylindrical straw.

4. The drinking straw of claim 3, wherein said straw-attachment element includes a generally cylindrical straw-engaging portion having an inner circumference approximately equal to an outer circumference of said straw, said straw-engaging portion adapted to be disposed about said cylindrical straw, and a connector portion connecting said straw-engaging portion to said second broad surface.

5. The drinking straw of claim 4, wherein said generally cylindrical straw-engaging portion is adapted to be slidably and removably disposed about said cylindrical straw, such that said display arrangement is slidably and removably mounted onto said cylindrical straw.

6. The drinking straw of claim 5, wherein a height of said display arrangement on said cylindrical straw is adjustable to a height of the cup.

7. The drinking straw of claim 1, wherein said graphic representation is adhesively applied onto said first broad surface.

8. The drinking straw of claim 1, wherein said graphic representation is printed onto, or otherwise forms an integral part of, said first broad surface.

9. The drinking straw of claim 1, wherein said display element comprises an electronic display element adapted to electronically display said graphic representation.

10. The drinking straw of claim 9, wherein said display arrangement further includes a power source powering said electronic display element.

11. The drinking straw of claim 9, wherein said display arrangement further includes a processor, adapted to control operation of said electronic display element and of said graphic representation displayed thereon.

12. The drinking straw of claim 1, wherein said cup-engaging element comprises a protrusion protruding out of said second broad surface and terminating in a convex shape.

13. A drinking straw usable for drinking a beverage from a cup, the cup having an exterior surface and an interior surface surrounding a hollow, the drinking straw comprising:

an elongate straw having a first end and a second end; and a display arrangement, comprising:

a display element having a first broad surface having a graphic representation visible thereon and a second broad surface;

said display element further comprises a housing portion having a hollow slot formed therein and including an interior portion and an exterior portion defining at least one transparent window; and a graphic-bearing portion having said graphic representation disposed thereon and adapted to be inserted into said hollow slot;

a straw-attachment element including a straw-engaging portion and a connector portion connecting said straw-engaging portion to said second broad surface; and a cup-engaging element comprising a protrusion protruding out of said second broad surface of said display element and terminating in a curved concave surface, wherein said elongate straw engaging element of said display arrangement is slidably and removably mounted about said elongate straw such that said second broad surface of said display element faces said elongate straw and said first end of said elongate straw is accessible to a user for drinking therefrom, and wherein, when said drinking straw is disposed in the cup, said elongate straw is adapted to be placed within the hollow of the cup adjacent the interior surface of the cup and said display arrangement is adapted to engage the exterior surface of the cup such that said graphic representation is disposed externally to the exterior surface to be visible through said at least one transparent window and the cup engaging element engages the exterior surface.

14. The drinking straw of claim 13, wherein:

said elongate straw comprises a cylindrical straw; and said straw-engaging portion is generally cylindrical and has an inner circumference approximately equal to an outer circumference of said cylindrical straw.

15. A drinking straw usable for drinking a beverage from a cup, the cup having an exterior surface and an interior surface surrounding a hollow, the drinking straw comprising:

a straw having a first end and a second end; and a display arrangement, comprising:

a display element having a first broad surface capable of displaying a language or graphic representation visible thereon and a second broad surface;

a straw-attachment element attached to said second broad surface of said display element; and a cup-engaging element connected to said second broad surface of said display element in alignment with said straw-attachment element, said cup-engaging element comprises a protrusion protruding out of said second broad surface and terminating in a curved surface, said curved surface adapted to engage the exterior surface of the cup along a contour thereof;

wherein said display arrangement is mounted onto said straw, via said straw-attachment element, such that said second broad surface of said display element faces said straw and said first end of said straw is accessible to a user for drinking therefrom, and wherein, when said drinking straw is disposed in the cup, said straw is adapted to be placed within the hollow of the cup adjacent the interior surface of the cup and said display arrangement is adapted to engage the exterior surface of the cup such that said language or graphic representation is disposed externally to the exterior surface and said cup-engaging element engages the exterior surface.

16. The drinking straw of claim 15, wherein said display element includes:

a housing portion having a hollow slot formed therein and including an interior portion and an exterior portion defining at least one transparent window; and a graphic-bearing portion having said graphic representation disposed thereon and adapted to be inserted into said hollow slot such that said graphic representation is visible through said at least one transparent window.

17. The drinking straw of claim 15, wherein said protrusion is flexible, such that a curvature of said concave surface adapts to a curvature of the external surface of the cup, and said straw is disposed along a longitudinal axis.

* * * * *